US011847989B2

(12) United States Patent
Yang et al.

(10) Patent No.: US 11,847,989 B2
(45) Date of Patent: Dec. 19, 2023

(54) PIXEL DRIVING CIRCUIT AND LIQUID CRYSTAL DISPLAY PANEL

(71) Applicant: TCL CHINA STAR OPTOELECTRONICS TECHNOLOGY CO., LTD., Guangdong (CN)

(72) Inventors: Guang Yang, Guangdong (CN); Yani Chen, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 3 days.

(21) Appl. No.: 17/600,027

(22) PCT Filed: Jul. 29, 2021

(86) PCT No.: PCT/CN2021/109116
§ 371 (c)(1),
(2) Date: Sep. 29, 2021

(87) PCT Pub. No.: WO2022/236968
PCT Pub. Date: Nov. 17, 2022

(65) Prior Publication Data

US 2022/0366866 A1 Nov. 17, 2022

(30) Foreign Application Priority Data

May 12, 2021 (CN) ..... 202110518533.9

(51) Int. Cl.
*G09G 5/10* (2006.01)
*G09G 3/36* (2006.01)

(52) U.S. Cl.
CPC ... *G09G 3/3611* (2013.01); *G09G 2300/0842* (2013.01); *G09G 2320/028* (2013.01); *G09G 2320/0242* (2013.01)

(58) Field of Classification Search
CPC ..... G09G 3/3611; G09G 2300/0842; G09G 2320/0242; G09G 2320/028; G02F 1/13624; G02F 1/136286; G02F 1/1368
USPC ..... 345/694
See application file for complete search history.

(56) References Cited

U.S. PATENT DOCUMENTS

2006/0119758 A1* 6/2006 Chai ..... G02F 1/134309 349/43
2018/0299734 A1* 10/2018 Gan ..... G02F 1/133707
2019/0129226 A1* 5/2019 Gan ..... G02F 1/134309
2019/0310509 A1* 10/2019 Shin ..... G02F 1/13452

FOREIGN PATENT DOCUMENTS

CN 106597714 A 4/2017
CN 106842750 A 6/2017
CN 106898326 A 6/2017
CN 107479287 A 12/2017
(Continued)

*Primary Examiner* — Jennifer T Nguyen
(74) *Attorney, Agent, or Firm* — HAMRE, SCHUMANN, MUELLER & LARSON, P.C.

(57) ABSTRACT

The present application provides a pixel driving circuit and a liquid crystal display panel. The pixel driving circuit comprises a main pixel electrode driving module, a sub-pixel electrode driving module, a first potential regulation module, and a second potential regulation module.

19 Claims, 3 Drawing Sheets

(56) References Cited

FOREIGN PATENT DOCUMENTS

| | | | | | |
|---|---|---|---|---|---|
| CN | 107561804 | A | | 1/2018 | |
| CN | 107817631 | A | | 3/2018 | |
| CN | 108735174 | A | | 11/2018 | |
| CN | 109471279 | A | | 3/2019 | |
| CN | 110967883 | | * | 4/2020 | ..... G02F 1/1362 |
| CN | 111061103 | A | | 4/2020 | |
| CN | 111176041 | A | | 5/2020 | |
| CN | 111323974 | A | | 6/2020 | |
| CN | 111326122 | A | | 6/2020 | |
| CN | 111489687 | A | | 8/2020 | |
| CN | 112259050 | A | | 1/2021 | |

* cited by examiner

PIXEL DRIVING CIRCUIT AND LIQUID CRYSTAL DISPLAY PANEL

FIELD OF INVENTION

The present application relates the field of display technology, and particularly to a pixel driving circuit and a liquid crystal display panel.

BACKGROUND OF INVENTION

In the vertical alignment liquid crystal display panel, the color shift issue under the large view angle is more significant since the birefringence of liquid crystals varies greatly in different view angles. One of the most widely used methods to improve this issue is the 8-domain display technology, which divides pixels into main pixels and sub-pixels and makes the liquid crystals of the main pixels and the sub-pixels to have different tilts. The color shift issue under the large view angle can be therefore improved.

However, because the different tilts of the main pixels and the sub-pixels is realized merely by the leakage design of the sub-pixels, the liquid crystal display panel using the 8-domain display technology has smaller regulating range of the view angle.

SUMMARY OF INVENTION

The present application provides a pixel driving circuit and a liquid crystal display panel, which can solve the technical issue of the small regulating range of the view angle of the existing liquid crystal display panel.

In a first aspect, the present application provides a pixel driving circuit, comprising:

a main pixel electrode driving module, receiving a data signal, a scan signal, a first common electrode signal and a second common electrode signal, and electrically connected to a first node, wherein the main pixel electrode driving module is configured to output the data signal to the first node based on the scan signal, the first common electrode signal and the second common electrode signal;

a sub-pixel electrode driving module, receiving the data signal, the scan signal, the first common electrode signal and the second common electrode signal, and electrically connected to a second node, wherein the sub-pixel electrode driving module is configured to output the data signal to the second node based on the scan signal, the first common electrode signal and the second common electrode signal;

a first potential regulation module, receiving the scan signal and a first electrode signal, and electrically connected to the first node, wherein the first potential regulation module is configured to regulate, under the control of the scan signal, a potential of the first node according to the first electrode signal; and a second potential regulation module, receiving the scan signal and a second electrode signal, and electrically connected to the second node, wherein the second potential regulation module is configured to regulate, under the control of the scan signal, a potential of the second node according to the second electrode signal.

In the pixel driving circuit provided by the present application, the main pixel electrode driving module comprises a first transistor, a first liquid crystal capacitor and a first storage capacitor;

a gate electrode of the first transistor receives the scan signal, one of a source electrode and a drain electrode of the transistor receives the data signal, and the other one of the source electrode and the drain electrode of the transistor is electrically connected to the first node;

a first terminal of the first liquid crystal capacitor is electrically connected to the first node, and a second terminal of the first liquid crystal capacitor receives the first common electrode signal; and a first terminal of the first storage capacitor is electrically connected to the first node, and a second terminal of the first storage capacitor receives the second common electrode signal.

In the pixel driving circuit provided by the present application, the sub-pixel electrode driving module comprises a second transistor, a second liquid crystal capacitor and a second storage capacitor;

a gate electrode of the second transistor receives the scan signal, one of a source electrode and a drain electrode of the second transistor receives the data signal, and the other one of the source electrode and the drain electrode of the second transistor is electrically connected to the second node;

a first terminal of the second liquid crystal capacitor is electrically connected to the second node, and a second terminal of the second liquid crystal capacitor receives the first common electrode signal; and a first terminal of the second storage capacitor is electrically connected to the second node, and a second terminal of the second storage capacitor receives the second common electrode signal.

In the pixel driving circuit provided by the present application, the first potential regulation module comprises a third transistor;

a gate electrode of the third transistor receives the scan signal, one of a source electrode and a drain electrode of the third transistor is electrically connected to the first node, and the other one of the source electrode and the drain electrode of the third transistor receives the first electrode signal.

In the pixel driving circuit provided by the present application, the second potential regulation module comprises a fourth transistor;

a gate electrode of the fourth transistor receives the scan signal, one of a source electrode and a drain electrode of the fourth transistor is electrically connected to the second node, and the other one of the source electrode and the drain electrode of the fourth transistor receives the second electrode signal.

In the pixel driving circuit provided by the present application, a potential of the first electrode signal is equal to a potential of the second common electrode signal.

In the pixel driving circuit provided by the present application, a potential of the first electrode signal is not equal to a potential of the second electrode signal.

In a second aspect, the present application further provides a liquid crystal display panel, comprising:

a plurality of data lines, wherein each of the data lines is configured to provide a data signal;

a plurality of scan lines, wherein each of the scan lines is configured to provide a scan signal; and a plurality of pixel units defined by cross areas of the plurality of the scan lines and the plurality of the data lines, wherein each of the pixel units comprises a pixel driving circuit, comprising:

a main pixel electrode driving module, receiving a data signal, a scan signal, a first common electrode signal and a second common electrode signal, and electrically connected to a first node, wherein the main pixel electrode driving module is configured to output the data signal to the first node based on the scan signal, the first common electrode signal and the second common electrode signal;

a sub-pixel electrode driving module, receiving the data signal, the scan signal, the first common electrode signal and the second common electrode signal, and electrically connected to a second node, wherein the sub-pixel electrode driving module is configured to output the data signal to the second node based on the scan signal, the first common electrode signal and the second common electrode signal;

a first potential regulation module, receiving the scan signal and a first electrode signal, and electrically connected to the first node, wherein the first potential regulation module is configured to regulate, under the control of the scan signal, a potential of the first node according to the first electrode signal; and a second potential regulation module, receiving the scan signal and a second electrode signal, and electrically connected to the second node, wherein the second potential regulation module is configured to regulate, under the control of the scan signal, a potential of the second node according to the second electrode signal.

In the liquid crystal display panel provided by the present application, the main pixel electrode driving module comprises a first transistor, a first liquid crystal capacitor and a first storage capacitor;

a gate electrode of the first transistor receives the scan signal, one of a source electrode and a drain electrode of the transistor receives the data signal, and the other one of the source electrode and the drain electrode of the transistor is electrically connected to the first node;

a first terminal of the first liquid crystal capacitor is electrically connected to the first node, and a second terminal of the first liquid crystal capacitor receives the first common electrode signal; and a first terminal of the first storage capacitor is electrically connected to the first node, and a second terminal of the first storage capacitor receives the second common electrode signal.

In the liquid crystal display panel provided by the present application, the sub-pixel electrode driving module comprises a second transistor, a second liquid crystal capacitor and a second storage capacitor;

a gate electrode of the second transistor receives the scan signal, one of a source electrode and a drain electrode of the second transistor receives the data signal, and the other one of the source electrode and the drain electrode of the second transistor is electrically connected to the second node;

a first terminal of the second liquid crystal capacitor is electrically connected to the second node, and a second terminal of the second liquid crystal capacitor receives the first common electrode signal; and a first terminal of the second storage capacitor is electrically connected to the second node, and a second terminal of the second storage capacitor receives the second common electrode signal.

In the liquid crystal display panel provided by the present application, the first potential regulation module comprises a third transistor;

a gate electrode of the third transistor receives the scan signal, one of a source electrode and a drain electrode of the third transistor is electrically connected to the first node, and the other one of the source electrode and the drain electrode of the third transistor receives the first electrode signal.

In the liquid crystal display panel provided by the present application, the second potential regulation module comprises a fourth transistor;

a gate electrode of the fourth transistor receives the scan signal, one of a source electrode and a drain electrode of the fourth transistor is electrically connected to the second node, and the other one of the source electrode and the drain electrode of the fourth transistor receives the second electrode signal.

In the liquid crystal display panel provided by the present application, a potential of the first electrode signal is equal to a potential of the second common electrode signal.

In the liquid crystal display panel provided by the present application, a potential of the first electrode signal is not equal to a potential of the second electrode signal.

In the liquid crystal display panel provided by the present application, the liquid crystal display panel further comprises a DBS electrode, disposed above the data lines, and configured to provide the first electrode signal to the pixel driving circuits.

In the liquid crystal display panel provided by the present application, the liquid crystal display panel further comprises a shared electrode, disposed below a pixel electrode, and configured to provide a second electrode signal to the pixel driving circuits.

In the liquid crystal display panel provided by the present application, the liquid crystal display panel further comprises a DBS electrode, disposed above the data lines, and configured to provide the first electrode signal to the pixel driving circuits.

In the liquid crystal display panel provided by the present application, the liquid crystal display panel further comprises a shared electrode, disposed below a pixel electrode, and configured to provide a second electrode signal to the pixel driving circuits.

In a third aspect, the present application further provides a liquid crystal display panel, comprising a pixel unit divided into a main pixel region and a sub-pixel region; wherein:

the main pixel region comprises a first transistor, a third transistor and a main pixel electrode, a gate electrode of the first transistor is connected to a corresponding scan line, one of a source electrode and a drain electrode of the first transistor is connected to a corresponding data line, and the other one of the source electrode and the drain electrode of the first transistor is connected to the main pixel electrode; a gate electrode of the third transistor is connected to a corresponding scan line, one of a source electrode and a drain electrode of the third transistor is connected to the main pixel electrode, and the other one of the source electrode and the drain electrode of the third transistor is connected to a DBS electrode;

the sub-pixel region comprises a second transistor, a fourth transistor and a sub-pixel electrode, a gate electrode of the second transistor is connected to a corresponding scan line, one of a source electrode and a drain electrode of the second transistor is connected to a corresponding data line, and the other one of the source electrode and the drain electrode of the second transistor is connected to the sub-pixel electrode; a gate electrode of the fourth transistor is connected to a corresponding scan line, one of a source electrode and a drain electrode of the fourth transistor is connected to the sub-pixel electrode, and the other one of the source electrode and the drain electrode of the fourth transistor is connected to a shared electrode.

In the liquid crystal display panel provided by the present application, the DBS electrode is disposed above the data line and configured to provide a first electrode signal, and wherein a potential of the first electrode signal is equal to a potential of second common electrode signal.

In the liquid crystal display panel provided by the present application, the shared electrode is disposed below the pixel electrodes and configured to provide a second electrode signal, and wherein the potential of the first electrode signal is not equal to a potential of the second electrode signal.

The pixel driving circuit and the liquid crystal display panel provided by the present application regulate the potential of the main pixel electrode module by disposing the first potential regulation module, and regulate the potential of the sub-pixel electrode module by disposing the second potential regulation module; that is, the present application can increase the regulating range of the view angle to improve the color shift under the large view angle by regulating the potential of the main pixel electrode driving module and the sub-pixel electrode driving module at the same time.

DETAILED DESCRIPTION OF EMBODIMENTS

In order to make purposes, technical solutions, and effects of the present application clearer and more specific, the present application is further described in detail below with reference to the accompanying drawings and examples. It should be understood that the specific embodiments described herein are only used to explain the present application, and are not used to limit the present application.

In addition, the terms "first" and "second" in the specification, the claims, and the figures of the present application are used to distinguish objects from each other, instead of describing a particular order. In addition, terms "comprise," "have," and any variation thereof are intended to cover non-exclusive inclusion.

Figure 1:
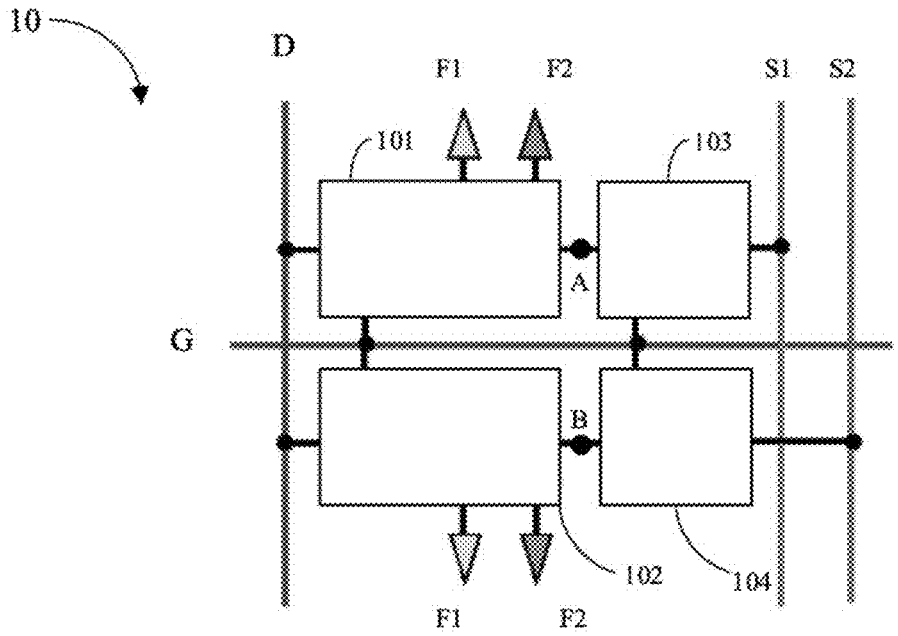
FIG. 1 is a structural schematic diagram of a pixel driving circuit in an embodiment of the present application.

Refer to FIG. 1, which is a structural schematic diagram of a pixel driving circuit in an embodiment of the present application. As shown in FIG. 1, a pixel driving circuit 10 provided by an embodiment of the present application comprises a main pixel electrode driving module 101, a sub-pixel electrode driving module 102, a first potential regulation module 103, and a second potential regulation module 104.

It should be noted that a liquid crystal display (LCD) panel comprises a plurality pixel units arranged in an array. In order to realize the eight-domain display technology, each pixel unit is divided into two regions having different voltage, which results in the liquid crystal molecules in each region to have different inclination angle, and thus have different brightness. The equivalent circuit of each pixel unit is illustrated as the pixel driving circuit as shown in FIG. 1.

Specifically, each pixel unit comprises a main pixel region and a sub-pixel region. The equivalent circuit of the main pixel region is illustrated as the main pixel electrode driving module 101 and the first potential regulation module 103 in the pixel driving circuit 10 as shown in FIG. 1; and the equivalent circuit of the sub-pixel region is illustrated as the sub-pixel electrode driving module 102 and the second potential regulation module 104.

The main pixel electrode driving module 101 receives the data signal D, the scan signal G, the first common electrode signal F1, and the second common electrode signal F2, and electrically connects to the first node A. The main pixel electrode driving module 101 is configured to output the data signal D to the first node A based on the scan signal G, the first common electrode signal F1, and the second common electrode signal F2.

The sub-pixel electrode driving module 102 receives the data signal D, the scan signal G, the first common electrode signal F1, and the second common electrode signal F2, and electrically connects to the second node B. The sub-pixel electrode driving module 102 is configured to output the data signal D to the second node B based on the scan signal G, the first common electrode signal F1, and the second common electrode signal F2.

The first potential regulation module 103 receives the scan signal G and the first electrode signal S1, and electrically connects to the first node A. The first potential regulation module 103 is configured to regulate, under the control of the scan signal S1, the potential of the first node A according to the first electrode signal S1.

The second potential regulation module 104 receives the scan signal G and the second electrode signal S2, and electrically connects to the second node B. The second potential regulation module 104 is configured to regulate, under the control of the scan signal G, the potential of the second node B according to the second electrode signal S2.

The difference between the present application and the prior art is that: the present application regulates the potential of the main pixel electrode driving module 101 by using the first potential regulation module 103, and regulates the potential of the sub-pixel electrode driving module 102 by using the second potential regulation module 104. In other words, the present application can increase the regulating range of the view angle by regulating the potential of the main pixel electrode driving module 101 and the sub-pixel electrode driving module 102 at the same time to improve the color shift under the large view angle.

Figure 2:
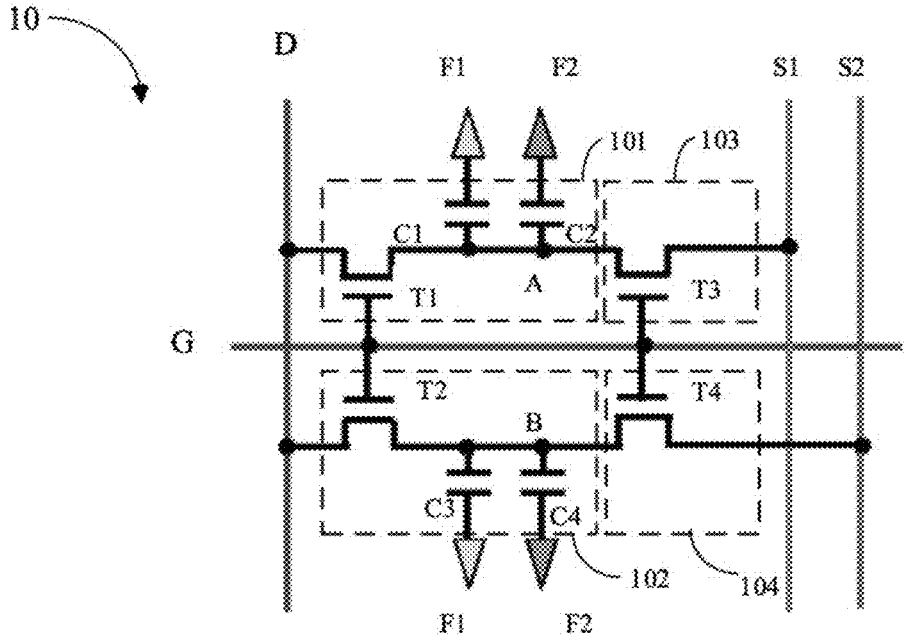
FIG. 2 is a schematic circuit diagram of a pixel driving circuit in an embodiment of the present application.

Refer to FIG. 2, which is a schematic circuit diagram of a pixel driving circuit in an embodiment of the present application. The main pixel electrode driving module 101, the sub-pixel electrode driving module 102, the first potential regulation module 103, and the second potential regulation module 104 in the pixel driving circuit 10 provided by the present application are described below in detail. It should be noted that the source electrode and the drain electrode of the transistor utilized in the present embodiment are interchangeable because the source electrode and the drain electrode are symmetric.

As shown in FIG. 1 and FIG. 2, the main pixel electrode driving module 101 comprises the first transistor T1, the first liquid crystal capacitor C1, and the first storage capacitor C2. The gate electrode of the first transistor T1 receives the scan signal G. One of the source electrode and the drain electrode of the first transistor T1 receives the data signal D. The other one of the source electrode and the drain electrode of the first transistor T1 is electrically connected to the first node A, wherein the first node A is the connection node between the drain electrode of the first transistor T1 and the source electrode of the third transistor T3. The first terminal of the first liquid crystal capacitor C1 is electrically connected to the first node A. The second terminal of the first liquid crystal capacitor C1 receives the first common electrode signal F1. The first terminal of the first storage capacitor C2 is electrically connected to the first node A. The second terminal of the first storage capacitor C2 receives the second common electrode signal F2.

As shown in FIG. 1 and FIG. 2, the sub-pixel electrode driving module 102 comprises the second transistor T2, the second liquid crystal capacitor C3, and the second storage capacitor C4. The gate electrode of the second transistor T2 receives the scan signal G. One of the source electrode and the drain electrode of the second transistor T2 receives the data signal D. The other one of the source electrode and the drain electrode of the second transistor T2 is electrically connected to the second node B, wherein the second node B is the connection node between the drain electrode of the second transistor T2 and the source electrode of the fourth transistor T4. The first terminal of the second liquid crystal capacitor C3 is electrically connected to the second node B. The second terminal of the second liquid crystal capacitor C3 receives the first common electrode signal F1. The first terminal of the second storage capacitor C4 is electrically connected to the second node B. The second terminal of the second storage capacitor C4 receives the second common electrode signal F2.

As shown in FIG. 1 and FIG. 2, the first potential regulation module 103 comprises the third transistor T3. The gate electrode of the third transistor T3 receives the scan signal G. One of the source electrode and the drain electrode of the third transistor T3 is electrically connected to the first node A. The other one of the source electrode and the drain electrode of the third transistor T3 receives the first electrode signal S1.

As shown in FIG. 1 and FIG. 2, the second potential regulation module 104 comprises the fourth transistor T4. The gate electrode of the fourth transistor T4 receives the scan signal G. One of the source electrode and the drain electrode of the fourth transistor is electrically connected to the second node B. The other one of the source electrode and the drain electrode of the fourth transistor T4 receives the second electrode signal S2.

It should be noted that, the specific circuit configuration of the main pixel electrode driving module 101, the sub-pixel electrode driving module 102, the first potential regulation module 103, and the second potential regulation module 104 provided by the present embodiment are merely an embodiment of the present application. It can be understood that the main pixel electrode driving module 101 can also be formed by a plurality of the first transistor T1 connected in series. The sub-pixel electrode driving module 102 can also be formed by a plurality of the second transistor T2 connected in series. The first potential regulation module 103 can also be formed by a plurality of the third transistor T3 connected in series. The second potential regulation module 104 can also be formed by a plurality of the fourth transistor T4 connected in series.

In some embodiments, the first transistor T1, the second transistor T2, the third transistor T3, and the fourth transistor T4 can be implemented by one or multiple of a low temperature poly-silicon thin-film transistor (LTPS TFT), an oxide semiconductor thin-film transistor, and an amorphous silicon thin-film transistor (a-Si:H TFT). Further, the transistors in the pixel driving circuit 10 can be selected from the same type of transistor, so as to avoid the impact on the pixel driving circuit 10 caused by the different types of transistor.

It can be understood that the LCD panel comprises an array substrate, a color film substrate, and a liquid crystal layer disposed between the array substrate and the color film substrate. The main pixel region comprises main pixel electrodes. The sub-pixel region comprises sub-pixel electrodes. The first liquid crystal capacitor C1 is formed by the main pixel electrode and the common electrode on the color film substrate. The first storage capacitor C2 is formed by the main pixel electrode and the common electrode line on the array substrate. The second liquid crystal capacitor C3 is formed by the sub-pixel electrode and the common electrode on the color film substrate. The second storage capacitor C4 is formed by the sub-pixel electrode and the common electrode line on the array substrate. In other words, the common electrode line on the array substrate receives the first common electrode signal F1; and common electrode on the color film substrate receives the second common electrode signal F2.

It can be understood that a black matrix (BM) is usually disposed above the data line for shading in the LCD panel, so as to improve the contrast of the LCD panel. However, due to the deviation of alignment accuracy between the array substrate and the color film substrate, the black matrix may shift, which leads to light leakage of the data line. The existing LCD panel removes the black matrix above the date line by using data line BM less (DBS) technology, which disposing a DBS electrode above the data lines to maintain the potential of the DBS electrode and the common electrode on the color film substrate at the same level. The corresponding liquid crystal molecules above the data lines can act as a shading by always remaining undeflected. In addition, since the DBS electrode and the data lines are disposed on the same array substrate, the deviation of alignment accuracy is relatively small and thus the issue of light leakage caused by the shift of BM can be prevented.

Accordingly, the first electrode signal S1 is received by the DBS electrode disposing on the array substrate. The second electrode signal S2 is received by the shared electrode disposing on the array substrate. The present embodiment can transmit the signal of the main pixel electrode driving module 101 to the DBS electrode by using the DBS electrode and transmit the signal of the sub-pixel electrode driving module 102 to the common electrode by using the common electrode, so as to increase the regulating range of the view angle by regulating the potential of the main pixel electrode driving module 101 and the sub-pixel electrode driving module 102 at the same time, and improve the color shift under the large view angle.

In some embodiments, the potential of the first electrode signal S1 is equal to the potential of the second common electrode signal F2. In other words, the present embodiment can cause the potential of the first electrode signal S1 received by the DBS electrode and the second common electrode signal F2 received by the common electrode on the color film substrate at the same level by disposing the third transistor T3 to connect to the DBS electrode. Therefore, the potential of the DBS electrode and the common electrode on the color film substrate can be set to equal, so that the corresponding liquid crystal molecules above the data lines can act as a shading by always remaining undeflected.

In some embodiments, the potential of the first electrode signal S1 is not equal to the potential of the second electrode signal. In other words, the present embodiment can cause the potential of the first electrode signal S1 and the second common electrode signal F2 at the different level by disposing the third transistor T3 to connect to the DBS electrode and disposing the fourth transistor T4 to connect the shared electrode, and thus the eight-domain display can be realized; and the regulating range of the view angle can also be increased to improve the color shift under the large view angle.

Figure 3:
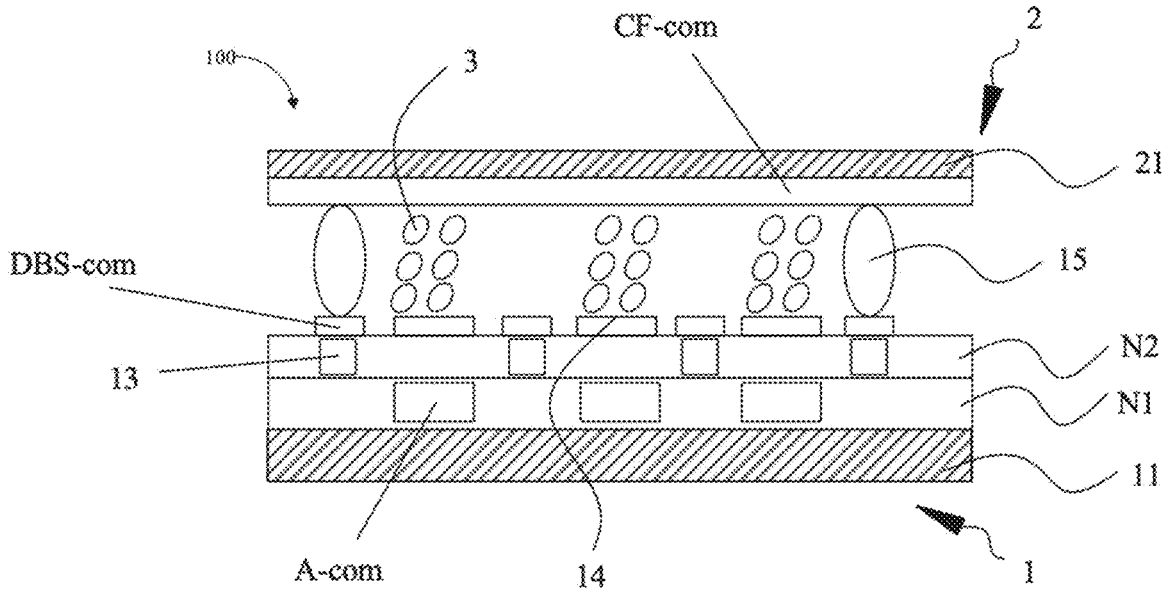
FIG. 3 is a structural schematic diagram of a liquid crystal display panel in an embodiment of the present application.

Refer to FIG. 3, which is a structural schematic diagram of a liquid crystal display panel in an embodiment of the present application. As shown in FIG. 3, the liquid crystal display panel 100 provided by the present embodiment comprises an array substrate 1, a color film substrate 2 disposed opposite to the array substrate 1, and a liquid crystal layer 3 disposed between the array substrate 1 and the color film substrate 2. A common electrode line A-com is disposed on the array substrate 1, and a common electrode CF-com is disposed on the color film substrate 2.

The array substrate 1 comprises a first glass substrate 11, in which a first metal layer N1 and a second metal layer N2 are disposed on the first glass substrate 11. The first metal layer N1 comprises the common electrode line A-com, a plurality of scan lines, and the gate electrode constituted the transistor (not shown in the figure). In the present embodiment, the common electrode line A-com, the scan lines, and the gate electrode constituted the transistor are formed on the same layer, in some embodiments, the common electrode line A-com, the scan lines, and the gate electrode constituted the transistor are formed on the different layers. The second metal layer N2 comprises a plurality of the data lines 13 and the source electrode and the drain electrode constituted the thin film transistor. The plurality of scan lines are crossed with the plurality of data lines 13 to define a plurality of pixel units 14. A plurality of DBS electrodes DBS-corn are disposed above the plurality of the data lines 13.

Specifically, the DBS electrodes DBS-com and the plurality of data line 13 are disposed correspondingly. The width of the DBS electrode DBS-com is larger than that of its corresponding data line 13, so that the electric field formed by the DBS electrode DBS-com can make the liquid crystal molecules in the liquid crystal layer 3 remaining in the undeflected state to shade the light. Thus, the black matrix (BM), corresponding to the data lines 13, of the liquid crystal display panel 100 can be replaced. Further, the material of the DBS electrodes DBS-COM can be Indium Tin Oxide (ITO).

Specifically, the pixel units 14 comprises red pixel unit, green pixel unit, and blue pixel unit which are sequentially and repeatedly arranged. The DBS electrodes are respectively disposed between the red pixel unit and the green pixel unit, between the green pixel unit and the blue pixel unit, and between the blue pixel unit and the red pixel unit.

The color film substrate 2 comprises a second glass substrate 21 and the common electrode CF-com disposed on the second glass substrate 21, wherein a golden ball 15 disposed between the DBS electrode DBS-com and the common electrode CF-com of the color film substrate 2 in order to implement the electrical connection between the DBS electrode DBS-com and the common electrode CF-com of the color film substrate 2. However, the medium for implementing the electrical connection between the DBS electrode DBS-COM and the common electrode CF-COM of the color film substrate 2 is not limited to the golden ball 15, and it can also be other types of the conductive medium. The present embodiment is not limited thereto.

Figure 4:
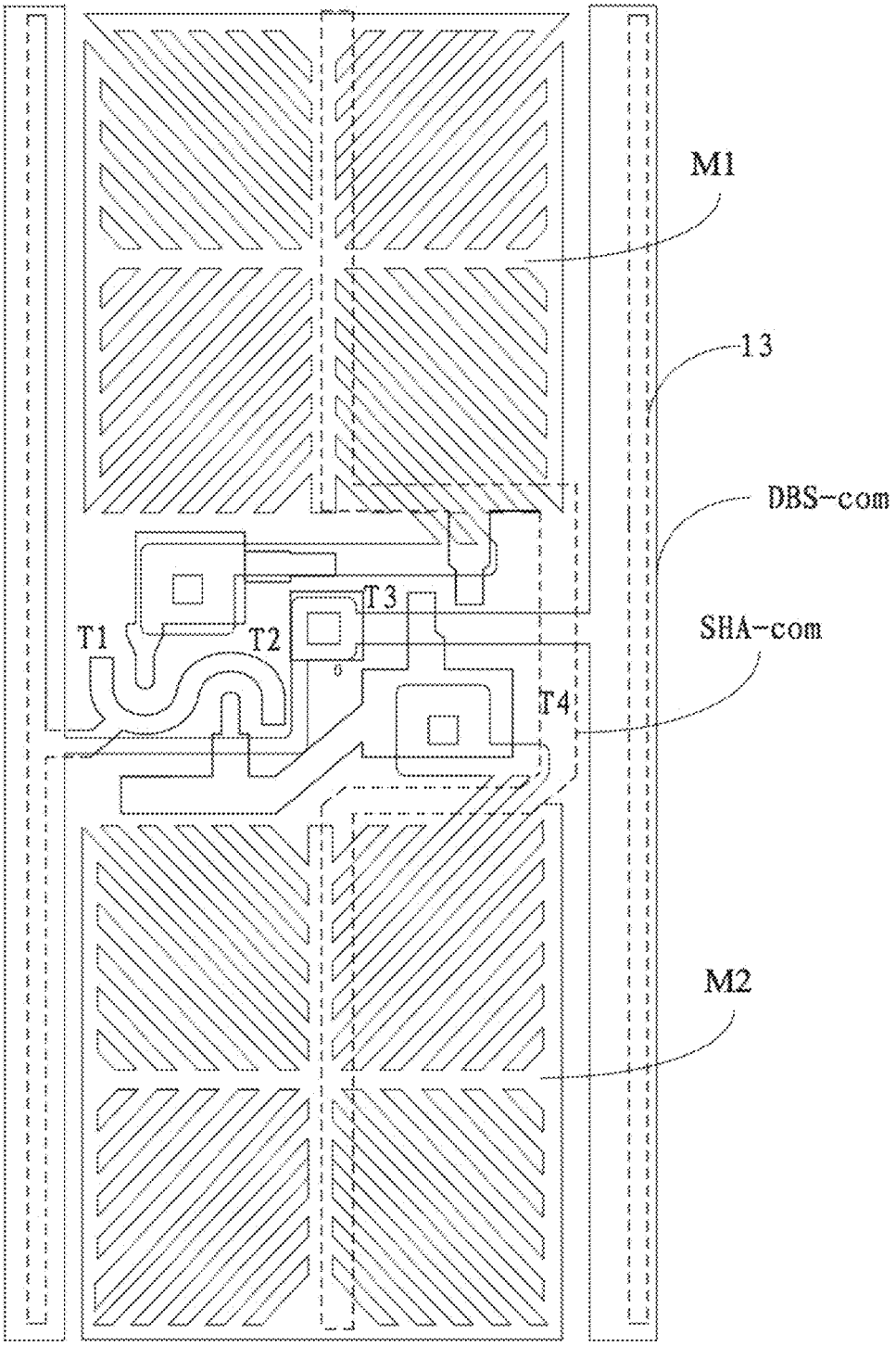
FIG. 4 is a structural schematic top view of an array substrate in an embodiment of the present application.

Further, the equivalent circuit diagram of each pixel unit 14 is shown in FIG. 2. Refer to FIG. 4, which is a structural schematic top view of an array substrate in an embodiment of the present application. As shown in FIG. 2, FIG. 3, and FIG. 4, each pixel unit 14 can be divided into a main pixel region and a sub-pixel region.

The main pixel region comprises the first transistor T1, the third transistor T3, and the main pixel electrode M1. The gate electrode of the first transistor T1 is connected to the corresponding scan line, one of the source electrode and the drain electrode of the first transistor T1 is electrically connected to the corresponding data line 13, and the other one of the source electrode and the drain electrode of the first transistor T1 is connected to the main pixel electrode M1. The gate electrode of the third transistor T3 is connected to the corresponding scan line, one of the source electrode and the drain electrode of the third transistor T3 is connected to the main pixel electrode M1, and the other one of the source electrode and the drain electrode of the third transistor T3 is connected to the DBS electrode DBS-com.

The sub-pixel region comprises the second transistor T2, the fourth transistor T4, and the sub-pixel electrode M2. The gate electrode of the second transistor T2 is connected to the corresponding scan line, one of the source electrode and the drain electrode of the second transistor T2 is connected to the corresponding data line 13, and the other one of the source electrode and the drain electrode of the second transistor T2 is connected to the sub-pixel electrode M2. The gate electrode of the fourth transistor T4 is connected to the corresponding scan line, one of the source electrode and the drain electrode of the fourth transistor T4 is connected to the sub-pixel electrode M2, and the other one of the source electrode and the drain electrode of the fourth transistor is connected to the shared electrode.

It should be noted that, the gate electrodes of the first transistor T1, the second transistor T2, the third transistor T3, and the fourth transistor T4 are connected to the scan lines; and the gate electrodes of the first transistor T1, the second transistor T2, the third transistor T3, and the fourth transistor T4 are not shown in FIG. 4.

It should be noted that, the first liquid crystal capacitor C1 is formed between the main pixel electrode M1 in the main pixel region and the common electrode CF-com on the color film substrate 2. The first storage capacitor C2 is formed by the main pixel electrode M1 in the main pixel region and the common electrode line A-com on the array substrate 1. The second liquid crystal capacitor C3 is formed between the sub-pixel electrode M2 in the sub-pixel region and the common electrode CF-com on the color film substrate 2. The second storage capacitor C4 is formed by the sub-pixel electrode M2 in the sub-pixel region and the common electrode line A-com on the array substrate 1. The common electrode CF-com on the color film substrate 2 receives the first common electrode signal F1, the common electrode line A-com on the array substrate 1 receives the second common electrode signal F2, the DBS electrode DBS-com receives the first electrode signal S1, and the shared electrode SHA-com receives the second electrode signal. The DBS electrode DBS-com is disposed below the data lines and configured to provide the first electrode signal S1 to the pixel driving circuit. The shared electrode SHA-com is disposed below the pixel electrodes (including the main pixel electrode M1 and the sub-pixel electrode M2) and configured to provide the second electrode signal S2 to the pixel driving circuit.

That is, the main pixel region is driven by both the first transistor T1 and the third transistor T3, in which the third transistor T3 is configured to pull down the potential of the main pixel region; and the sub-pixel region is driven by both the second transistor T2 and the fourth transistor T4, in which the fourth transistor T4 is configured to pull down the potential of the sub-pixel region.

In some embodiments, the electrode patterns of the main pixel electrode M1 and the sub-pixel electrode M2 are star shape, and both the main pixel electrode M1 and the sub-pixel electrode M2 are made of ITO.

By turning on, through the scan lines, the first transistor T1, the second transistor T2, the third transistor T3, and the fourth transistor T4 at the same time, the voltage of the main pixel electrode M1 can be released to the DBS electrode DBS-com via the third transistor T3 and the voltage of the sub-pixel electrode M2 can be released to the shared electrode SHA-com via the fourth transistor T4. Thus, the liquid crystal display panel 100 provided by the present application can increase the regulating range of the view angle to improve the color shift under the large view angle.

The difference between the present application and prior art is that the present application regulates the potential of the main pixel electrode M1 and the sub-pixel electrode M2 at the same time; and the prior art merely regulates the potential of the sub-pixel electrode M2. That is, in the prior art, the different settings of the main pixel electrode M1 and the sub-pixel electrode M2 is achieved by regulating the potential of sub-pixel electrode M2 to improve the color shift under the large view angle. In the present application, the potential of the main pixel electrode M1 and the sub-pixel electrode M2 can be regulated at the same time, and thus the regulating range of the view angle can be further enlarged compared to the prior art, so as to better resolve the color shift issue under the large view angle.

It can be understood that those having ordinary skills of the art may easily contemplate various changes and modifications of the technical solution and technical ideas of the present application and all these changes and modifications are considered within the protection scope of right for the present application.

What is claimed is:

1. A pixel driving circuit, comprising:

a main pixel electrode driving module, receiving a data signal, a scan signal, a first common electrode signal and a second common electrode signal, and electrically connected to a first node, wherein the main pixel electrode driving module is configured to output the data signal to the first node based on the scan signal, the first common electrode signal and the second common electrode signal;

a sub-pixel electrode driving module, receiving the data signal, the scan signal, the first common electrode signal and the second common electrode signal, and electrically connected to a second node, wherein the sub-pixel electrode driving module is configured to output the data signal to the second node based on the scan signal, the first common electrode signal and the second common electrode signal;

a first potential regulation module, receiving the scan signal and a first electrode signal, and electrically connected to the first node, wherein the first potential regulation module is configured to regulate, under the control of the scan signal, a potential of the first node according to the first electrode signal; and a second potential regulation module, receiving the scan signal and a second electrode signal, and electrically connected to the second node, wherein the second potential regulation module is configured to regulate, under the control of the scan signal, a potential of the second node according to the second electrode signal.

2. The pixel driving circuit as claimed in claim 1, wherein the main pixel electrode driving module comprises a first transistor, a first liquid crystal capacitor and a first storage capacitor;

a gate electrode of the first transistor receives the scan signal, one of a source electrode and a drain electrode of the transistor receives the data signal, and the other one of the source electrode and the drain electrode of the transistor is electrically connected to the first node;

a first terminal of the first liquid crystal capacitor is electrically connected to the first node, and a second terminal of the first liquid crystal capacitor receives the first common electrode signal; and a first terminal of the first storage capacitor is electrically connected to the first node, and a second terminal of the first storage capacitor receives the second common electrode signal.

3. The pixel driving circuit as claimed in claim 1, wherein the sub-pixel electrode driving module comprises a second transistor, a second liquid crystal capacitor and a second storage capacitor;

a gate electrode of the second transistor receives the scan signal, one of a source electrode and a drain electrode of the second transistor receives the data signal, and the other one of the source electrode and the drain electrode of the second transistor is electrically connected to the second node;

a first terminal of the second liquid crystal capacitor is electrically connected to the second node, and a second terminal of the second liquid crystal capacitor receives the first common electrode signal; and a first terminal of the second storage capacitor is electrically connected to the second node, and a second terminal of the second storage capacitor receives the second common electrode signal.

4. The pixel driving circuit as claimed in claim 1, wherein the first potential regulation module comprises a third transistor;

a gate electrode of the third transistor receives the scan signal, one of a source electrode and a drain electrode of the third transistor is electrically connected to the first node, and the other one of the source electrode and the drain electrode of the third transistor receives the first electrode signal.

5. The pixel driving circuit as claimed in claim 1, wherein the second potential regulation module comprises a fourth transistor;

a gate electrode of the fourth transistor receives the scan signal, one of a source electrode and a drain electrode of the fourth transistor is electrically connected to the second node, and the other one of the source electrode and the drain electrode of the fourth transistor receives the second electrode signal.

6. The pixel driving circuit as claimed in claim 1, wherein a potential of the first electrode signal is equal to a potential of the second common electrode signal.

7. The pixel driving circuit as claimed in claim 1, wherein a potential of the first electrode signal is not equal to a potential of the second electrode signal.

8. A liquid crystal display panel, comprising:

a plurality of data lines, wherein each of the data lines is configured to provide a data signal;

a plurality of scan lines, wherein each of the scan lines is configured to provide a scan signal; and a plurality of pixel units defined by cross areas of the plurality of the scan lines and the plurality of the data lines, wherein each of the pixel units comprises a pixel driving circuit, comprising:

a main pixel electrode driving module, receiving a data signal, a scan signal, a first common electrode signal and a second common electrode signal, and electrically connected to a first node, wherein the main pixel electrode driving module is configured to output the data signal to the first node based on the scan signal, the first common electrode signal and the second common electrode signal;

a sub-pixel electrode driving module, receiving the data signal, the scan signal, the first common electrode signal and the second common electrode signal, and electrically connected to a second node, wherein the sub-pixel electrode driving module is configured to output the data signal to the second node based on the scan signal, the first common electrode signal and the second common electrode signal;

a first potential regulation module, receiving the scan signal and a first electrode signal, and electrically connected to the first node, wherein the first potential regulation module is configured to regulate, under the control of the scan signal, a potential of the first node according to the first electrode signal; and a second potential regulation module, receiving the scan signal and a second electrode signal, and electrically connected to the second node, wherein the second potential regulation module is configured to regulate, under the control of the scan signal, a potential of the second node according to the second electrode signal.

9. The liquid crystal display panel as claimed in claim 8, wherein the main pixel electrode driving module comprises a first transistor, a first liquid crystal capacitor and a first storage capacitor;

a gate electrode of the first transistor receives the scan signal, one of a source electrode and a drain electrode of the transistor receives the data signal, and the other one of the source electrode and the drain electrode of the transistor is electrically connected to the first node;

a first terminal of the first liquid crystal capacitor is electrically connected to the first node, and a second terminal of the first liquid crystal capacitor receives the first common electrode signal; and a first terminal of the first storage capacitor is electrically connected to the first node, and a second terminal of the first storage capacitor receives the second common electrode signal.

10. The liquid crystal display panel as claimed in claim 8, wherein the sub-pixel electrode driving module comprises a second transistor, a second liquid crystal capacitor and a second storage capacitor;

a gate electrode of the second transistor receives the scan signal, one of a source electrode and a drain electrode of the second transistor receives the data signal, and the other one of the source electrode and the drain electrode of the second transistor is electrically connected to the second node;

a first terminal of the second liquid crystal capacitor is electrically connected to the second node, and a second terminal of the second liquid crystal capacitor receives the first common electrode signal; and a first terminal of the second storage capacitor is electrically connected to the second node, and a second terminal of the second storage capacitor receives the second common electrode signal.

11. The liquid crystal display panel as claimed in claim 8, wherein the first potential regulation module comprises a third transistor;

a gate electrode of the third transistor receives the scan signal, one of a source electrode and a drain electrode of the third transistor is electrically connected to the first node, and the other one of the source electrode and the drain electrode of the third transistor receives the first electrode signal.

12. The liquid crystal display panel as claimed in claim 8, wherein the second potential regulation module comprises a fourth transistor;

a gate electrode of the fourth transistor receives the scan signal, one of a source electrode and a drain electrode of the fourth transistor is electrically connected to the second node, and the other one of the source electrode and the drain electrode of the fourth transistor receives the second electrode signal.

13. The liquid crystal display panel as claimed in claim 8, wherein a potential of the first electrode signal is equal to a potential of the second common electrode signal.

14. The liquid crystal display panel as claimed in claim 8, wherein a potential of the first electrode signal is not equal to a potential of the second electrode signal.

15. The liquid crystal display panel as claimed in claim 8, wherein the liquid crystal display panel further comprises a Data line Black Matrix Less (DBS) electrode, disposed above the data lines, and configured to provide the first electrode signal to the pixel driving circuits.

16. The liquid crystal display panel as claimed in claim 8, wherein the liquid crystal display panel further comprises a shared electrode, disposed below a pixel electrode, and configured to provide a second electrode signal to the pixel driving circuits.

17. A liquid crystal display panel comprising a pixel unit divided into a main pixel region and a sub-pixel region; wherein:

the main pixel region comprises a first transistor, a third transistor and a main pixel electrode, a gate electrode of the first transistor is connected to a corresponding scan line, one of a source electrode and a drain electrode of the first transistor is connected to a corresponding data line, and the other one of the source electrode and the drain electrode of the first transistor is connected to the main pixel electrode; a gate electrode of the third transistor is connected to a corresponding scan line, one of a source electrode and a drain electrode of the third transistor is connected to the main pixel electrode, and the other one of the source electrode and the drain electrode of the third transistor is connected to a DBS electrode; wherein the main pixel electrode is connected to a first common electrode signal through a first liquid crystal capacitor and is connected to a second common electrode signal through a first storage capacitor;

the sub-pixel region comprises a second transistor, a fourth transistor and a sub-pixel electrode, a gate electrode of the second transistor is connected to a corresponding scan line, one of a source electrode and a drain electrode of the second transistor is connected to a corresponding data line, and the other one of the source electrode and the drain electrode of the second transistor is connected to the sub-pixel electrode; a gate electrode of the fourth transistor is connected to a corresponding scan line, one of a source electrode and a drain electrode of the fourth transistor is connected to the sub-pixel electrode, and the other one of the source electrode and the drain electrode of the fourth transistor is connected to a shared electrode; wherein the sub-pixel electrode is connected to the first common electrode signal through a second liquid crystal capacitor and is connected to the second common electrode signal through a second storage capacitor.

18. The liquid crystal display panel as claimed in claim 17, wherein the DBS electrode is disposed above the data line and configured to provide a first electrode signal, and wherein a potential of the first electrode signal is equal to a potential of second common electrode signal.

19. The liquid crystal display panel as claimed in claim 18, wherein the shared electrode is disposed below the pixel electrodes and configured to provide a second electrode signal, and wherein the potential of the first electrode signal is not equal to a potential of the second electrode signal.

* * * * *